United States Patent [19]

Morihashi

[11] Patent Number: 4,894,886

[45] Date of Patent: Jan. 23, 1990

[54] BLENDED YARN PRODUCING DEVICE

[75] Inventor: Toshifumi Morihashi, Ohtsu, Japan

[73] Assignee: MurataKikai Kabushiki Kaisha, Kyoto, Japan

[21] Appl. No.: 97,601

[22] Filed: Sep. 16, 1987

[30] Foreign Application Priority Data

Sep. 18, 1986 [JP] Japan ..... 61-219966

[51] Int. Cl.[4] ..... D01H 1/00; D02G 3/36

[52] U.S. Cl. ..... 19/244; 19/258; 19/288; 57/315

[58] Field of Search ..... 19/244, 258, 288; 57/315

[56] References Cited

U.S. PATENT DOCUMENTS

| | | | |
|---|---|---|---|
| 3,020,697 | 2/1962 | Herry | 19/288 X |
| 3,133,320 | 5/1964 | Swanson | 19/288 |
| 3,895,417 | 7/1975 | Zimmermann | 19/288 |
| 3,918,127 | 11/1975 | Amsler | 19/244 X |
| 4,259,766 | 4/1981 | Copoulos | 19/288 X |
| 4,445,252 | 5/1984 | Morihashi et al. | 19/244 |
| 4,551,887 | 11/1985 | Uematsu | 19/244 |

FOREIGN PATENT DOCUMENTS

| | | |
|---|---|---|
| 57-167420 | 10/1982 | Japan . |
| 59-07812 | 2/1984 | Japan . |

*Primary Examiner*—Louis K. Rimrodt

*Attorney, Agent, or Firm*—Spensley Horn Jubas & Lubitz

[57] ABSTRACT

A blended yarn producing device includes a draft device having back rollers, middle rollers and front rollers and a twisting device succeeding the draft device, which is constituted such that a trumpet guide for introducing slivers of different types separately at upper and lower locations is located on the sliver entrance side of the back roller.

17 Claims, 3 Drawing Sheets

BLENDED YARN PRODUCING DEVICE

FIELD OF THE INVENTION

This invention relates to a blended yarn producing device.

DESCRIPTION OF THE RELATED ART

It is well known in the art of spinning process to blend fibers of different qualities, for example, a chemical synthetic fiber and a natural fiber, to produce a composite fiber which exhibits advantageous characteristics of both original fibers.

For example, in a Japanese Patent Publication No. 59-7812 which were already applied for patent by the same applicant, an embodiment is disclosed wherein a composite fiber includes a first central yarn layer, a second layer of a different quality surrounding the first layer, and a third layer holding the first and second layers fast from outside, and the first layer is made of polyester while the second and third layers are made of cotton.

One of problems which appear when such a blended yarn as described above is produced is that, depending upon a supplying condition of two different types of slivers to be supplied, a fiber for the first layer may be displaced from the central position, and in some cases, a fiber to make the first layer may project from a surface of an outermost layer of a yarn. Accordingly, characteristics of the yarn may be different from aimed ones, and yarns of good qualities may not be produced.

OBJECT AND SUMMARY OF THE INVENTION

It is an object of the present invention to provide a spinning apparatus for producing a spun yarn wherein a central portion and an outer peripheral portions are formed from fibers of different qualities.

The illustrated embodiments of the present invention provide a blended yarn producing device for a spinning apparatus which includes a draft device having back rollers, middle rollers and front rollers all constituting draft rollers, and a twisting device succeeding the draft device, which is constituted such that a trumpet guide for introducing slivers of different types separately at upper and lower locations is located on the sliver entrance side of the back roller.

DETAILED DESCRIPTION OF THE INVENTION

Now, an embodiment of the present invention will be described with reference to the drawings.

Figure 1:
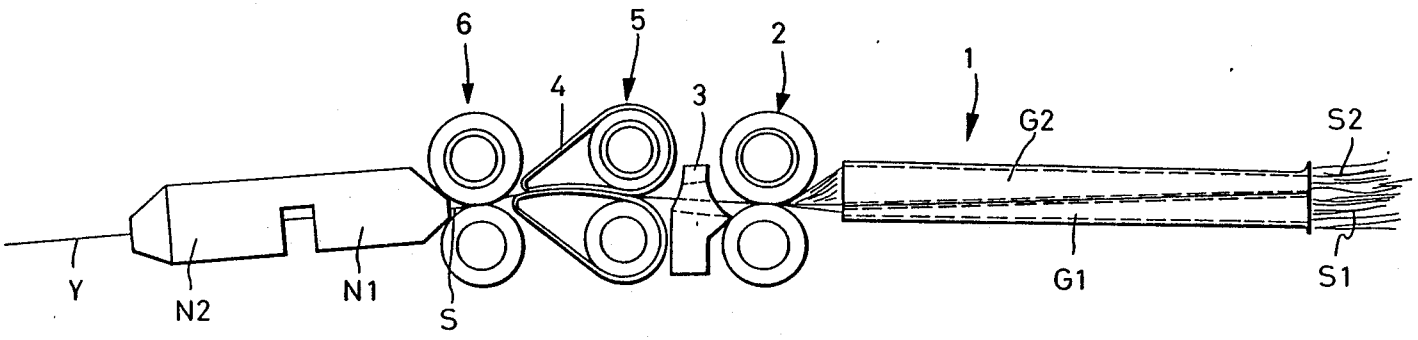
FIG. 1 is a view of general construction showing an example of pneumatic spinning apparatus to which a device of the present invention is applied.

FIG. 1 shows a view of general construction wherein an embodiment of the present invention is applied to a pneumatic spinning apparatus.

In particular, two types of slivers S1, S2 drawn out from separately placed sliver cans not shown are supplied, without passing a roving process, separately to a guide 1 including a pair of vertically separated trumpet guides G1, G2 and then pass between a pair of back rollers 2 and through a sliver guide 3 and then between a pair of middle rollers 5 each having an apron 4 mounted thereon and further between a pair of front rollers 6 so that they are successively drafted by those rollers.

Further, a sliver S which is forwarded in the form of a bundle of fibers having a thickness corresponding to a single yarn from the front rollers 6 is acted upon by a pair of pneumatic spinning nozzles N1, N2 to make a spun yarn Y. The spun yarn Y is then positively drawn out by way of a yarn guide and delivery rollers not shown and then passes necessary steps such as a traverse guide and friction rollers whereafter it is wound into a package, thereby completing a sequence of spinning steps.

The rollers 2, 5, 6 have different circumferential speeds, and the difference in circumferential speed is small between the back rollers 2 and the middle rollers 5 and is large between the middle rollers 5 and the front rollers 6. The former difference is called brake draft while the latter is called main draft, and the product of the brake draft and the main draft makes a total draft.

Figure 3:
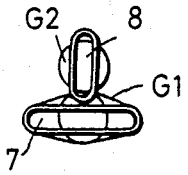
FIG. 3 a side elevational view showing a shape of an exit of the trumpet guide of FIG. 2.
Figure 2:
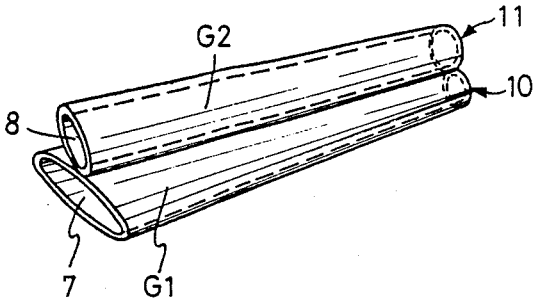
FIG. 2 a perspective view showing a shape of a trumpet guide.

Now, the trumpet guide 1 located on the upstream side of the back rollers 2 will be described with reference to FIGS. 2 and 3. The trumpet guide 1 in which sliver passages are provided separately at upper and lower locations includes the first trumpet guide G1 for guiding a first sliver S1 which is to be arranged on the outer side of a yarn to be spun, and the second trumpet guide G2 for guiding a second sliver S2 which is to be arranged on the central location of a yarn to be spun. In particular, the first trumpet guide G1 on the lower side has at an exit 7 thereof a horizontally elongated circular or elliptical shape for a sliver while the second trumpet guide G2 on the upper side has at an exit 8 thereof a vertically elongated circular or elliptical shape. It is to be noted that each of sliver entrances 10, 11 of the trumpet guides G1, G2 may have any circular or non-circular shape having such a sectional area as to allow a sliver of any type to be readily admitted thereinto and need not have a specific limited shape. An inner wall between the entrance and the exit of each of the trumpet guides G1, G2 is interconnected smoothly. Further, the exit 8 of the second trumpet guide G2 is located at the central position in the horizontal direction of the exit 7 of the first trumpet guide G1, and the sectional area of each of the exits may be suitably selected in accordance with a ratio between amounts of fibers of the inner and outer layers of a yarn to be spun.

A second embodiment of a trumpet guide is illustrated in FIGS. 10 through 16. A trumpet guide 101 is formed in one body and a first trumpet guide G101 and a second trumpet guide G102 are separately formed by a thin plate member 120. The first trumpet guide G101 guides the first sliver S1 which is to be arranged on the outer side of a yarn and the second trumpet guide G102 guides the second sliver S2 which is to be arranged on the central location of a yarn. The entrances 110, 111 of the trumpet guides G101, G102 have semi-circular shapes. An exit 107 of the first trumpet guide G101 has a horizontally elongated circular or slit-like shape while an exit 108 of the second trumpet guide G102 has a vertically elongated circular or slit-like shape.

Figure 6:
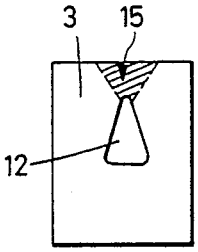
FIGS. 4 to 6 show an example of sliver guide 3, and FIG. 4 being a front elevational view, FIG. 5 a right-hand side elevational view of FIG. 4, and FIG. 6 a left-hand side elevational view of FIG. 4.
Figure 4:
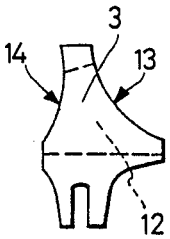
Figure 5:
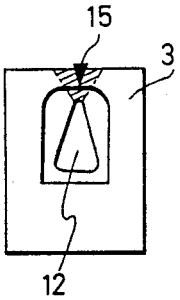

Now, the sliver guide 3 located between the back rollers 2 and the middle rollers 5 will be described with reference to FIGS. 4 to 6. The sliver guide has such a sectional shape that, of two types of slivers supplied to the back rollers 2, the first sliver which is to make the outer layer may be completely surrounded by a periphery of the second sliver which is to make the center layer.

In particular, the sliver passage 12 has a substantially triangular shape in cross section, and the sectional area at the exit 14 is smaller than that at the sliver entrance 13. The inner wall of the sliver passage 12 for guiding a sliver is interconnected smoothly so that a sliver will advance from the entrance to the exit while decreasing its cross sectional area so as to allow the first sliver to surround the periphery of the second sliver. It is to be noted that it is possible to remove a portion 15 as indicated by chain lines and hatching lines from an upper portion of the sliver guide 2 so as to open the passage 12 at the top thereof.

Operation of the spinning apparatus having such a construction as described above will be described.

Figure 8:
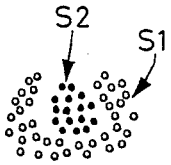
FIG. 8 a view showing a state of a sliver within the sliver guide 3.
Figure 7:
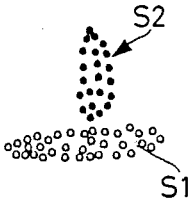
FIG. 7 is a view showing a state of a sliver at an exit of the guide 3.
Figure 13:
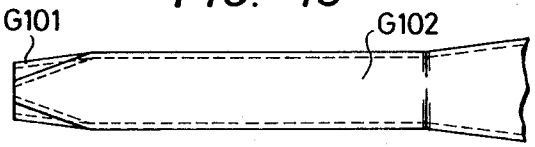
FIG. 13 a partial plan view showing an exit portion of the trumpet guide of FIG. 10.
Figure 10:
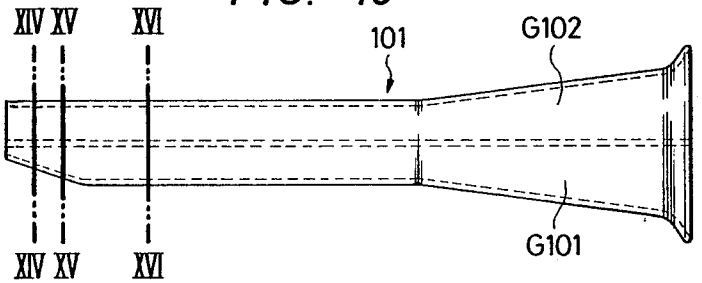
FIG. 10 a side view showing another embodiment of a trumpet guide.
Figure 11:
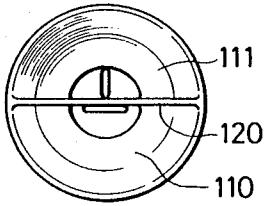
FIG. 11 a right-hand side view showing a shape of an entrance of the trumpet guide of FIG. 10.
Figure 12:
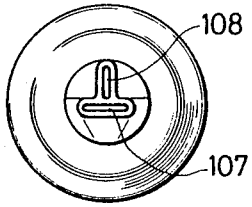
FIG. 12 a left-hand side view showing a shape of an exit of the trumpet guide of FIG. 10.
Figure 14:
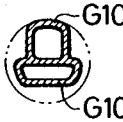
FIGS. 14 through 16 sectional views taken on lines XIV—XIV, XV—XV and XVI—XVI of FIG. 10, respectively.
Figure 15:
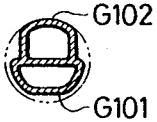
Figure 16:
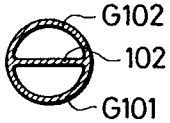

For example, a cotton sliver is used as the first sliver S1 while a polyesters sliver is used as the second sliver S2. As the slivers pass the trumpet guide 1, the first sliver S1 is deformed into a horizontally flattened shape while the second sliver S2 is deformed into a vertically elongated shape (FIG. 7). The two slivers having passed the trumpet guides G1, G2 are further formed into a flattened sliver having the second sliver concentrated at a central location thereof by the back rollers 2 and are then supplied from the back rollers to the sliver guide 3. As the sliver passes the sliver guide 3, the flattened first sliver S1 which has formerly been located below the second sliver S2 is deformed so that it may surround the second sliver S2 as seen in FIG. 8. Thus, the sliver with the first sliver surrounding the second sliver is supplied to and thus drafted by the middle rollers 5.

Figure 9:
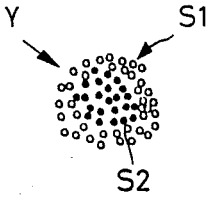
FIG. 9 a view showing a spun yarn.

The sliver having come out of the front rollers 5 in this manner is then formed, by the pneumatic nozzles N1, N2, into a spun yarn Y as shown in FIG. 9 wherein the second sliver S2 is positioned at the center and is surrounded by the first sliver S1 outside. The principle of the spinning process described above is disclosed in Japanese Patent Laid-Open No. 57-167420. In particular, there is an arrangement wherein a sliver S which is fed by the front rollers 6 is spun by the first balloon producing nozzle N1 and the second balloon producing nozzle N2 which is located rearwardly of the first balloon producing nozzle and produces a whirling flow in a direction opposite to the direction of a whirling flow produced by the first balloon producing nozzle. A trailing end of fibers of a sliver S forwarded from the front rollers 6 which fibers are in an unrestricted free condition at ends thereof is twisted and caught by a twist of the sliver itself which is propagated from the second temporary twist providing nozzle N2 immediately after it has been forwarded from the front rollers 6, and then the free end side of the fibers thus caught is wrapped in a direction opposite to the direction of the twist of a core fiber bundle which is already made by the sliver at the first balloon producing nozzle N1 around the core fiber bundle by a balloon produced by the first balloon producing nozzle N1, whereafter the wrapping of the outer wrapped fibers is strengthened by a whirling flow of the second temporary twist providing nozzle N2, thereby to form a yarn having such a cross section as shown in FIG. 9.

Accordingly, where the first sliver is made is cotton while the second sliver is made of polyester, a yarn is produced wherein the cotton is located on the outer side and the polyester is located at the center thereof. Thus, the appearance the cotton has appears outside, which makes the fashionability of the yarn abundant. Meanwhile, due to the presence of the polyester, a fabric can be woven which is high in strength, can bear against washing and does not readily yield wrinkles.

Slivers of different qualities can be blended in a spinning process, and a spun yarn can be obtained wherein the central portion and an outer peripheral portion are formed from fibers of different qualities. Besides, a yarn can be produced wherein an inner layer and an outer layer of fibers can be distinguished clearly, and a yarn having characteristics of fibers of different qualities can be produced.

What is claimed is:

1. A blended yarn producing device for a spinning apparatus which includes a draft device having back rollers, middle rollers and front rollers, and a twisting device succeeding said draft rollers, the device comprising:

a trumpet guide device for introducing fiber slivers of first and second different types separately, located on the sliver entrance side of said back rollers; and blended sliver forming means for forming the sliver of the first type around the circumference of the sliver of the second type resulting in a blended sliver having a circumferential layer of fiber of the sliver of the first type substantially surrounding an inner layer of fibers of the sliver of the second type.

2. A blended yarn producing device as claimed in claim 1, wherein said trumpet guide device comprises a first trumpet guide for guiding the sliver of the first type which is to be arranged on the outer side of a yarn to be spun, and a second trumpet guide for guiding the sliver of the second type which is to be arranged on the central location of a yarn to be spun, said first and second trumpet guides being substantially tubular and being arranged substantially parallel to each other.

3. A blended yarn producing device as claimed in claim 2, wherein said first trumpet guide is located on the lower side and said second trumpet guide is located on the upper side of the trumpet guide device.

4. A blended yarn producing device as claimed in claim 3, wherein said first trumpet guide has a horizontally elongated circular shaped exit for the first sliver while said second trumpet guide has a vertically elongated circular shaped exit for the second sliver.

5. A blended yarn producing device as claimed in claim 4, wherein the exit of said second trumpet guide is located at the central position in the horizontal direction of the exit of the first trumpet guide.

6. A blended yarn producing device as claimed in claim 5, wherein the sectional area of each of the exits is suitably selected in accordance with a ratio between amounts of fibers of the inner and outer layers of a yarn to be spun.

7. A blended yarn producing device as claimed in claim 1, wherein the blended sliver forming means comprises a sliver guide provided between the back rollers and the middle rollers for forming the first sliver to make an outer layer substantially completely surrounding a periphery of the second sliver forming the center layer.

8. A blended yarn producing device as claimed in claim 7, wherein said sliver guide has a sliver passage which has a substantially triangular shape in cross section at an exit of the sliver guide and has a smaller sectional area at the exit than at an entrance of the sliver guide.

9. A blended yarn producing device as claimed in claim 8, wherein an opening of the sliver passage is formed at the top of said sliver guide extended along the sliver passage.

10. A blended yarn producing apparatus for producing a blended yarn from the fibers of a first and second sliver, the yarn producing apparatus being operable with a draft device having at least one pair of draft rollers arranged to pass the first and second slivers therebetween, the yarn producing apparatus comprising:

a sliver guide for guiding the first and second slivers to the at least one pair of draft rollers;

sliver forming means, arranged adjacent the at least one pair of draft rollers, for forming the first sliver around the second sliver to provide a resulting sliver having an outer circumference of fibers of the first sliver substantially surrounding an inner core of fibers of the second sliver.

11. A blended yarn producing apparatus as claimed in claim 10, wherein the sliver forming means has folding means for folding the first sliver about the circumference of the second sliver so as to surround substantially the entire circumference of the second sliver with the first sliver.

12. A blended yarn producing apparatus as claimed in claim 11 wherein the sliver guide comprises:

a first trumpet guide for guiding the first sliver; and a second trumpet guide for guiding the second sliver;

wherein the first and second trumpet guides are arranged adjacent and substantially parallel to each other.

13. A blended yarn producing apparatus as claimed in claim 12 wherein the first trumpet guide has a first exit aperture for passing the first sliver therethrough and the second trumpet guide has a second exit aperture for passing the second sliver therethrough, said first exit aperture being elongated in a first direction and said second exit aperture being arranged adjacent the first exit aperture and centered with respect to the elongated direction of the first exit aperture.

14. A blended yarn producing apparatus as claimed in claim 11, wherein the sliver forming means comprises a sliver guide for guiding the first and second slivers from the at least one pair of draft rollers, the sliver guide having a substantially triangular shaped sliver passage, the sliver passage having an entrance and an exit aperture, the entrance aperture having a larger cross section than the exit aperture.

15. A blended yarn producing apparatus as claimed in claim 14, wherein the sliver passage has a top in which is provided an opening extending along the sliver passage.

16. A blended sliver producing device for producing a blended sliver from fibers of a first sliver and fibers of a second sliver, the device comprising:

first shaping means for shaping the first sliver into a substantially ribbon shaped sliver having a flattened surface flanked on either side by an edge extending substantially in the axial direction of the sliver;

guide means for guiding the second sliver and the ribbon shaped sliver and for positioning the second sliver adjacent the ribbon shaped sliver and centered substantially with respect to the width between the edges of the ribbon shaped; and second shaping means for folding the edges of the ribbon shaped sliver around substantially the entire periphery of the second sliver;

whereby a blended sliver is produced having a circumferential layer of fibers of the first sliver substantially surrounding an inner layer of fibers of a second sliver.

17. A system for producing a blended yarn with fibers of a first sliver forming a circumferential layer substantially surrounding the periphery of a layer of fibers of a second sliver, the system comprising the steps of:

shaping the first sliver into a sliver having a substantially flattened surface extending in the axial direction of the sliver;

positioning the second sliver adjacent the flattened surface of the first sliver;

folding the flattened surface of the first sliver about the outer periphery of the second sliver to form a blended sliver; and drafting the blended sliver by a drafting device.

* * * * *